United States Patent [19]

Röck et al.

[11] Patent Number: 4,641,396

[45] **Date of Patent: * Feb. 10, 1987**

[54] FURNITURE HINGE WITH AXLE MEMBERS MOUNTING HINGE LINKS TO HINGE CASING AND RETAINED IN HOLDING FLANGES

[75] Inventors: Erich Röck, Höchst; Klaus Brüstle, Lauterach, both of Austria

[73] Assignee: Julius Blum Gesellschaft mbH, Höchst, Austria

[ * ] Notice: The portion of the term of this patent subsequent to Nov. 12, 2002 has been disclaimed.

[21] Appl. No.: 714,085

[22] Filed: Mar. 20, 1985

[30] Foreign Application Priority Data

Apr. 17, 1984 [AT] Austria ..... 1278/84

[51] Int. Cl.[4] ..... E05D 3/06

[52] U.S. Cl. ..... 16/370; 16/386

[58] Field of Search ..... 16/282, 288, 294, 302, 16/366, 370, 386

[56] References Cited

U.S. PATENT DOCUMENTS

| | | | |
|---|---|---|---|
| 4,368,559 | 1/1983 | Oepping et al. | 16/370 X |
| 4,551,883 | 11/1985 | Rock et al. | 16/370 |

FOREIGN PATENT DOCUMENTS

| | | | |
|---|---|---|---|
| 1285913 | 12/1968 | Fed. Rep. of Germany | 16/370 |
| 2029843 | 3/1978 | Fed. Rep. of Germany | 16/370 |
| 6610049 | 1/1967 | Netherlands | 16/386 |

*Primary Examiner*—Fred Silverberg

*Attorney, Agent, or Firm*—Wenderoth, Lind & Ponack

[57] ABSTRACT

A furniture hinge includes a hinge arm which is connected with a hinge casing by way of two hinge links. One hinge link is mounted in the hinge casing by a through pin. The other hinge link is mounted in the hinge casing by two first journals which are part of two U-shaped axle members which also have second journals. The axle members are positioned with respect to each other in a mirror image manner. The two second journals are held by at least one holding flange which is punched out from the hinge casing and which has two sides connected to the hinge casing.

6 Claims, 4 Drawing Figures

FURNITURE HINGE WITH AXLE MEMBERS MOUNTING HINGE LINKS TO HINGE CASING AND RETAINED IN HOLDING FLANGES

FIELD AND BACKGROUND OF THE INVENTION

The invention relates to a furniture hinge comprising a hinge arm adapted to be fastened to a first furniture part and a hinge casing adapted to be inserted into a second furniture part, the hinge arm and the hinge casing being connected by means of inner and outer hinge links, and axles mounting the hinge links in the hinge casing and at the hinge arm, thus forming a hinge quadrangle. The outer hinge link is mounted in the hinge casing on axle members having two journals and one connecting member and being inserted into the hinge casing through holes from the outer side. An interspace is provided between the ends of the journals which carry the outer hinge link.

Hinges of this kind are for example known from the DE-OS No. 29 26 486, corresponding to U.S. Pat. No. 4,368,559.

SUMMARY OF THE INVENTION

It is the object of the invention to improve the mounting of the hinge links in hinges of the afore-mentioned kind such that the hinge links include no bearing axle member which extends through the hinge casing, so that the space within the hinge link, which preferably has a U-shaped, is empty, and that no journals freely extend through the hinge casing.

Such object in accordance with the present invention must also fulfill the requirement that the journals for the hinge link in the hinge casing must be stably aligned, even when the wall of the hinge casing is thin and relatively weak.

According to the invention, this is achieved in that in the hinge casing two axle members are positioned with respect to each other in a mirror image manner, and that one journal of each of the axle members extends between a holding flange inside the hinge casing and the hinge casing wall, such holding flanges being punched out from the hinge casing wall and linked thereto at two sides.

It is advantageously provided that the holding flanges are arranged in the transition region between the hinge casing wall and the hinge casing bottom, and that they are anchored to the hinge casing wall as well as to the hinge casing bottom. Due to the arrangement of the journals in the corner between the side wall and the bottom of the hinge casing, correct alignment of the journals is guaranteed.

It is advantageously provided that the two axle members have, in a manner known per se, a longer and a shorter journal, and that the longer journals extend behind the holding flanges of the hinge casing, while the two shorter journals jointly carry the outer hinge link.

The mounting stability of the axle members can be substantially improved by welding, soldering or gluding the two axle members to the hinge casing.

In an embodiment of the afore-mentioned kind, the journals are aligned in an absolutely secure manner. Moreover, the forces acting on the two journals can be diverted to relatively large surfaces of the hinge casing.

The hinge casing in accordance with the present invention advantageously is punched from sheet steel.

In an embodiment of the invention there is provided that the length of each longer journal substantially corresponds to half the inside width of the hinge casing in the region of the axle members and in the direction of the axles.

BRIEF DESCRIPTION OF THE DRAWINGS

In the following an embodiment of the invention will be described in more detail with reference to the accompanying drawings, in which.

Figure 1:
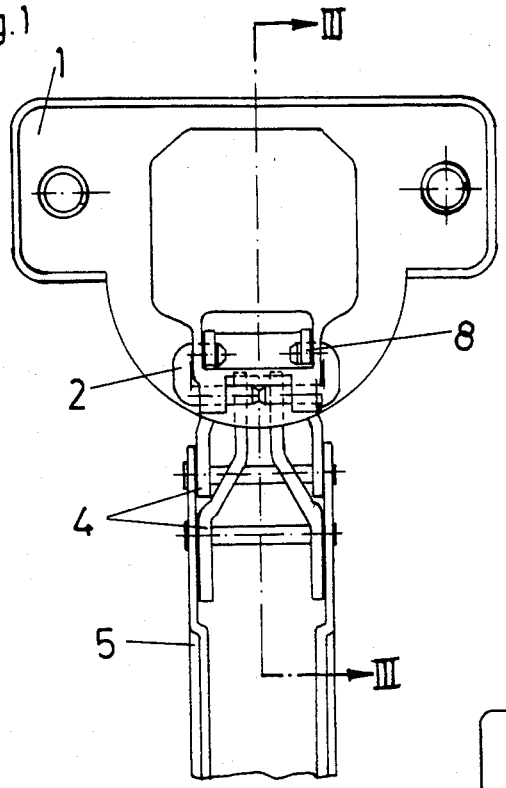
FIG. 1 is a top view of the lower side of a furniture hinge in accordance with the present invention.
Figure 2:
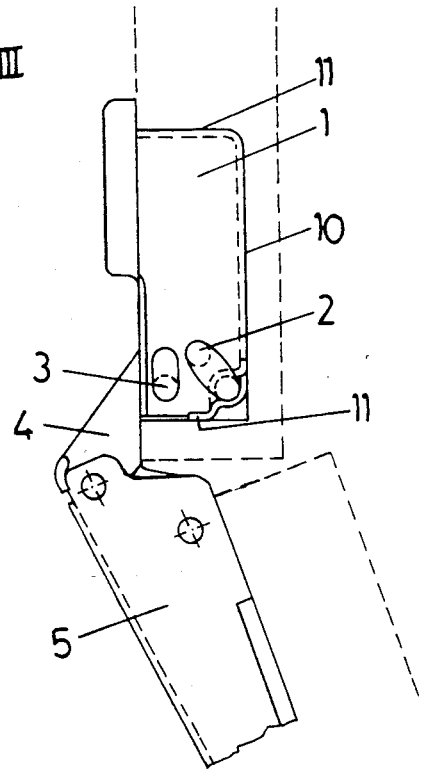
FIG. 2 is a side view of such furniture hinge.
Figure 3:
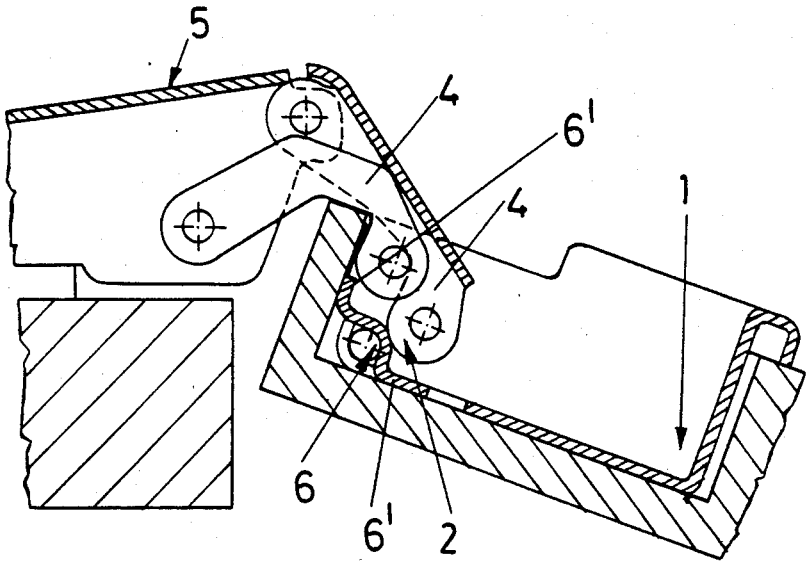
FIG. 3 is a sectional view along line III—III of FIG. 1.
Figure 4:
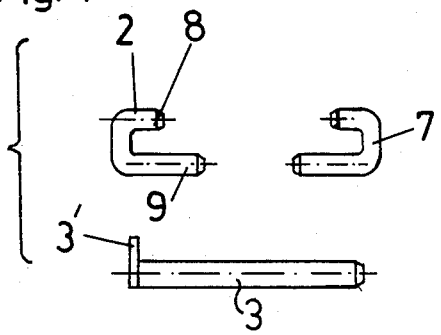
FIG. 4 is a schematic view of the parts of the hinge which form the hinge axles.

In the drawings, the adjustment screws and the fastening screws for the hinge arm as well as the mounting plate have not been illustrated, since such parts are made according to the state of the art and are not the subject of the present invention.

DESCRIPTION OF THE PREFERRED EMBODIMENT

The hinge according to the present invention has at the side near a furniture door a hinge casing 1 in which are mounted inner and outer hinge links 4 which are connected to a hinge arm mounted on a furniture wall.

The outer hinge link 4 is mounted on journals 8 which are parts of two U-shaped axle members 2 also having journals 9. A connecting member 7, each axle member 2 extends between the journals 8,9 thereof.

The journals 9 are longer than the journals 8, and the two axle members 2 are associated or positioned with respect to each other in a mirror-inverted or mirror image manner.

The outer hinge link 4 has a U-shaped profile, and due to the axle members 2 designed in accordance with the present invention, the inside width or space between side flanges 4' of the outer hinge link 4 is free.

The two longer journals 9 of the axle members 2 extend into a type of channel or eye which is formed between holding flanges 6 and the wall of the hinge casing 1 so that, even under stress, a stable alignment of the axle members is guaranteed by the hinge link 4. The holding flanges 6 are punched out from a bottom 10 and from walls 11 of the hinge casing 1 and form a bridge which is inwardly bent into the hinge casing 1. The holding flanges 6 hence extend at two sides 6' into the hinge casing wall.

The ends of the two journals 9 extend, in the present embodiment, to the longitudinal center plane of the hinge casing 1 which corresponds to the line III—III.

The inner hinge link 4 is mounted on a pin 3 which projects, in a manner known per se, through the hinge casing 1. The pin 3 has a stop 3' to facilitate mounting operations.

The axle members 2 may be flattened in the region of the connecting members 7 to provide a better connecting surface with the hinge casing 1.

What is claimed is:

1. A furniture hinge comprising:

a hinge arm to be mounted on a first furniture part;

a hinge casing to be fitted to a second furniture part, said hinge casing having a bottom, walls extending from said bottom, and at least one holding flange punched from one said wall and extending into the interior of said hinge casing, said holding flange having two sides connected to said hinge casing and defining with said hinge casing a channel extending transversely thereof;

inner and outer hinge links having first ends pivoted to said hinge arm and second ends pivoted to said hinge casing; and means pivotally mounting said second end of said outer hinge link to said hinge casing, said mounting means comprising first and second axle members, each said axle member including first and second journals extending parallel to each other and joined by a transversely extending connecting member, said first journals being shorter than said second journals, said first and second axle members being positioned as mirror images of each other with said journals extending through spaced side walls of said hinge casing into said interior thereof, with said first journals directed toward each other along substantially the same axis with a space therebetween, and with said second journals directed toward each other along substantially the same axis, said second end of said outer hinge link being pivotally mounted on said first journals, and said second journals extending into and being pivotally retained within said channel between said holding flange and said hinge casing.

2. A hinge as claimed in claim 1, comprising two said holding flanges, each said second journal extending into a channel defined between said hinge casing and a respective said holding flange.

3. A hinge as claimed in claim 1, wherein said holding flange extends into said interior of said hinge casing in a corner transition area between said bottom and said one wall, and said two sides of said holding flange are connected respectively to said bottom and said one wall.

4. A hinge as claimed in claim 1, wherein said one wall comprises a wall of said hinge casing extending parallel to said axes.

5. A hinge as claimed in claim 1, wherein said axle members are fixed to respective said side walls of said hinge casing.

6. A hinge as claimed in claim 1, wherein said hinge casing is formed of sheet steel.

* * * * *